US009255676B2

(12) United States Patent
Hoog

(10) Patent No.: US 9,255,676 B2
(45) Date of Patent: Feb. 9, 2016

(54) TUBULAR LUMINAIRE

(71) Applicant: Manuel Hoog, Saratoga, CA (US)

(72) Inventor: Manuel Hoog, Saratoga, CA (US)

(73) Assignee: Energy Savings Technology, LLC, Milpitas, CA (US)

( * ) Notice: Subject to any disclaimer, the term of this patent is extended or adjusted under 35 U.S.C. 154(b) by 138 days.

(21) Appl. No.: 14/216,626

(22) Filed: Mar. 17, 2014

(65) Prior Publication Data

US 2015/0092417 A1 Apr. 2, 2015

Related U.S. Application Data

(60) Provisional application No. 61/884,093, filed on Sep. 29, 2013.

(51) Int. Cl.

| | |
|---|---|
| ***F21V 14/04*** | (2006.01) |
| ***F21S 8/02*** | (2006.01) |
| ***F21V 17/10*** | (2006.01) |
| ***F21V 17/12*** | (2006.01) |
| ***F21V 17/16*** | (2006.01) |
| ***F21V 21/30*** | (2006.01) |
| *F21Y 101/02* | (2006.01) |

(52) U.S. Cl.

CPC ..... *F21S 8/026* (2013.01); *F21V 17/105* (2013.01); *F21V 17/12* (2013.01); *F21V 17/162* (2013.01); *F21V 21/30* (2013.01); *F21Y 2101/02* (2013.01)

(58) Field of Classification Search

CPC ..... F21S 8/02; F21S 8/026; F21V 21/30; F21V 21/04; F21V 14/04; F21V 15/01; F21V 17/00; F21V 17/02; F21V 17/041; F21V 17/105

See application file for complete search history.

(56) References Cited

U.S. PATENT DOCUMENTS

| | | | | |
|---|---|---|---|---|
| 2,716,185 | A | 8/1955 | Burliuk et al. | |
| 6,152,571 | A | 11/2000 | Ruiz | |
| 7,303,327 | B2 | 12/2007 | Copeland et al. | |
| 8,029,158 | B2 | 10/2011 | Chen | |
| 8,042,973 | B2 | 10/2011 | Inoue et al. | |
| 8,047,687 | B2 | 11/2011 | Inoue et al. | |
| 8,079,736 | B2 | 12/2011 | Inoue et al. | |
| 2010/0315812 | A1* | 12/2010 | Liu | F21S 8/02 362/235 |
| 2012/0281409 | A1 | 11/2012 | Patkus et al. | |
| 2012/0287625 | A1* | 11/2012 | Macwan | F21V 29/004 362/235 |
| 2012/0320577 | A1 | 12/2012 | Wang | |
| 2013/0010470 | A1* | 1/2013 | Min | F21V 7/0025 362/238 |
| 2014/0204574 | A1* | 7/2014 | Ebisawa | F21V 29/763 362/235 |

* cited by examiner

*Primary Examiner* — Peggy Neils
(74) *Attorney, Agent, or Firm* — Gard & Kaslow LLP

(57) ABSTRACT

A luminaire having a tubular body that fits into a ceiling mounted sleeve that allows azimuthal rotation of a light beam. The luminaire features an upright tubular heat sink connected to a fixed base having a downward portion inclined at an angle where an LED chip is affixed. The chip is sandwiched in place by a reflector holder having a rim that centers a rotating reflector that admits light from the LED and forms a beam. The angular inclination of the reflector is additive with the angle of the inclined portion of the base allowing vertical angle adjustment of the beam independently of the azimuthal adjustment.

19 Claims, 9 Drawing Sheets

TUBULAR LUMINAIRE

CROSS-REFERENCE TO RELATED APPLICATION

This application claims priority from provisional application Ser. No. 61/884,093, filed Sep. 29, 2013.

TECHNICAL FIELD

The invention relates to decorative luminaires, and in particular to a variable angle, variable beamwidth, ceiling mounted luminaire.

BACKGROUND ART

In U.S. Pat. No. 2,716,185 D. Burliuk and E. Rambusch devised a luminaire construction that featured a selectively titling luminaire that could be installed in a mounting ring either entirely from below a ceiling or entirely from above the ceiling. The luminaire has a finishing plate mounted to a ceiling that is apertured to admit a lamp and to allow the light to escape. This plate supports two housing members, the lower of which is adjustable about a vertical axis, allowing tilting of the lamp, while the upper is adjustable on the lower about a sloping axis. The upper part carries the lamp, wiring and a cooling structure. By reaching through the aperture in the finishing plate, a user can adjust the lamp housing parts about the respective axes so as to vary the slope of the lamp axis and its orientation about the vertical axis. This dual adjustability of the beam slope and orientation have largely been overlooked in modern lamps. Beam slope is adjustable by forming the lamp housing in two portions including a peripheral spherical upper portion that is trimmed to a 22.5 degree angle and a lower portion, also having a peripheral edge trimmed to 22.5 degrees, with the lower portion rotatable relative to the upper portion, being held in position with clips. By rotating the lower portion relative to the upper portion, the beam angle may be adjusted at radial angles ranging from 0 degrees to 45 degrees in a selectively tiltable manner. Moreover, once a selected angle is set, the fixture may be axially rotated about 360 degrees of the vertical axis so that the beam may be directed in any desired direction.

A selectable tilt, similar to the '185 patent is described in U.S. Pat. No. 6,152,571 where two angled plates surrounding a lamp and beam rotate relative to each other so that a selected angle of the beam relative to a flush mount may be set, where the selected angle is relative to the beam direction. In U.S. Pat. No. 7,303,327 S. Copeland and M. Thompson describe an LED in which the direction of the emitted light can be controlled by adjusting a portion of the housing and/or by controlling the orientation of the LED array within the housing. In. U.S. Pat. No. 8,029,158 J. Chen describes an LED light module that includes heat dissipating radial fins. Heat generated by the LED light is conducted from a flat portion of the LED to the fins for dissipation. Another such structure is shown and described in U.S. Patent Publ. 2012/0281409 to S. Patkus et al. In U.S. Pat. Nos. 8,042,973; 8,047,687; and 8,079,736 M. Inoue et al. describe use of multiple LEDs with multiple reflector sections within a tubular heat sink structure with fins extending in the axial direction. U.S. Patent Publ. 2012/0320577 shows a titling LED lamp structure that includes radial fins in the axial direction.

One of the problems of the tilting lamps of the prior art is that the radial swing of a mounted lamp housing can interfere with wiring or cabling in a ceiling that is installed subsequently in the vicinity of the housing. As the housing is rotated it can sometimes contact nearby wiring causing wear on the insulation of the wiring or, in extreme cases, shorting of the wiring or the lamp.

SUMMARY DISCLOSURE

The invention is a luminaire of the type intended for mounting in a ceiling or the like. The entire profile of the device is cylindrical, including a rearwardly extending tubular heat sink with a central axis that remains stationary, unlike prior art luminaires that tilted in order to tilt an emergent beam. The present invention can vertically tilt an emergent beam while remaining stationary in a upright position and also swing the beam to a desired azimuthal angle. In other words, the present luminaire has a variable lateral angle beam as well as azimuthal rotation of the entire assembly, giving two independent angular beam motions. For example, a beam from the luminaire can be pointed to a spot on a wall, then the angle of the beam relative to the spot, up or down, can be changed, and the luminaire can be rotated so that a different wall spot is illuminated.

Forward of the stationary heat sink are rotational components, including a rotating reflector that reflects light from an attached light emitting board and a base member that supports the board and the reflector. The base member has one surface end joined to the heat sink while the opposite end surface is inclined at a first angle relative to the axis of the heat sink. At the same time, the reflector has a peripheral portion inclined at a second angle relative to the axis of the device such that rotation of the reflector causes additive combination of the first and second angles to achieve a desired amount of beam-tilt. A typical range of tilting extends from zero degrees, where the beam is axially symmetric, to 45 degrees. To achieve a 45 degree tilt, each of the first and second angles would be 22.5 degrees so that the additive combination is 45 degrees. The reflector has a radially inward tapered cylindrical surface reflective of light into a cone, allowing light from the light emitting board to pass into the center of the reflector where a beam is given its shape. A cylindrical housing can surround the reflector and a portion of the base. The housing coaxially fits within a fixed tubular mounting sleeve, usually attached to a ceiling. Rotating the housing within the fixed sleeve gives the second rotational opportunity for the beam independent of reflector rotation with the attached base.

DETAILED DESCRIPTION

Figure 1B:
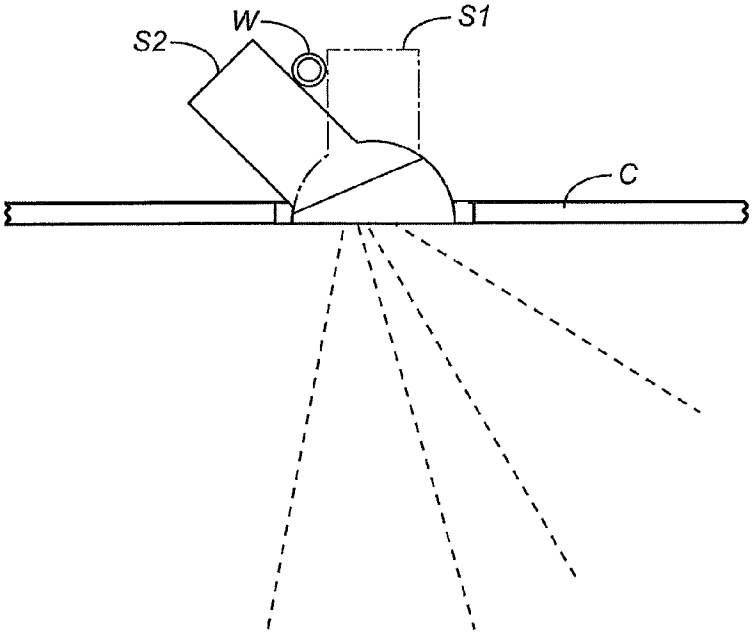
FIG. 1B (PRIOR ART)
FIG. 1B is a side view of a type of luminaire of the prior art mounted in a ceiling.
Figure 1A:
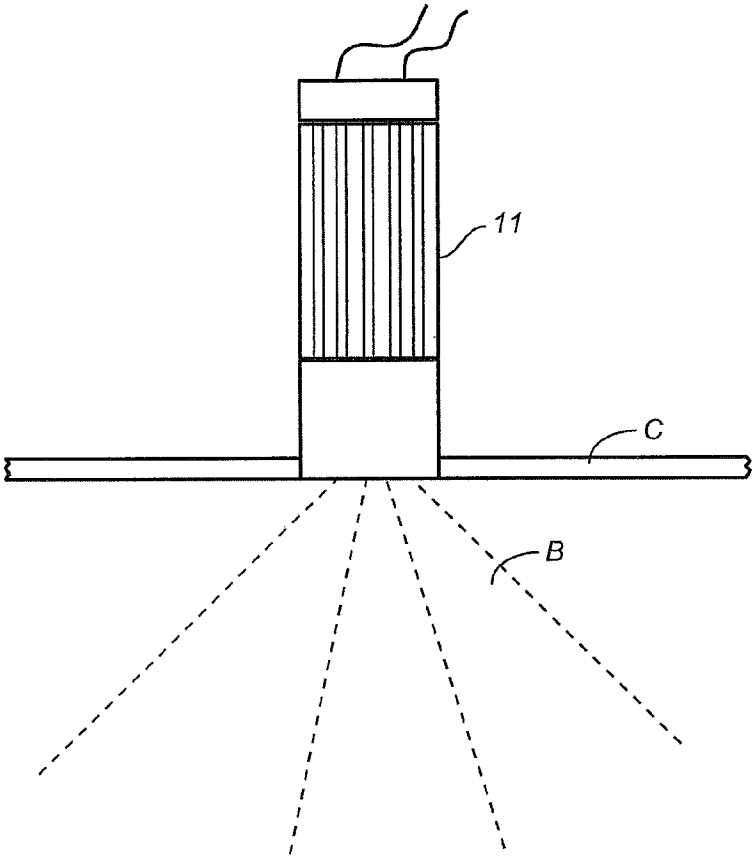
FIG. 1A is a side view of a luminaire of the invention mounted in a ceiling.

With reference to FIG. 1A, a luminaire 11 of the present invention is shown mounted in a ceiling, C, directing a beam of light downwardly. The luminaire 11 is seen to be tubular in overall construction with the beam, B, being symmetric about a cylindrical axis. It is desirable to have the beam tilt and rotate. In the prior art this was accomplished, as shown in FIG. 1B, where a luminaire has a first position, S1. In order to tilt the beam, the rear portion fixture was tilted as shown by the luminaire in position, S2. A problem that occurs is that if a ceiling cable or pipe, W, is placed next to the luminairing position, S1, the wire, W, interferes with tilting and, some instances, prevents tilting. On the other hand, the luminaire of the present invention allows tilting and/or rotation of the beam, keeping the tubular body stationary. Any cables or wires placed next to the luminaire are inconsequential.

Figure 2A:
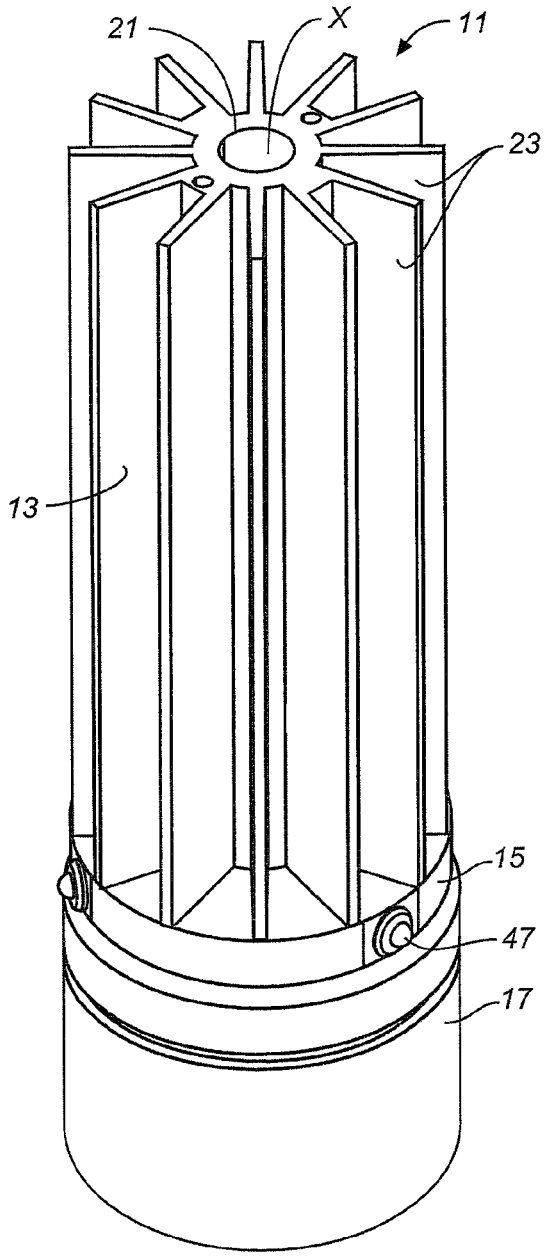
FIG. 2A is an upper perspective view of the luminaire shown in FIG. 1A.

With reference to FIG. 2A, the luminaire 11 is seen to have a generally tubular heat sink body with a central axis, X, that is coaxial with a central hole 21. The central hole is used to pass an electrical temperature probe to reduce power to an LED if overheating is detected. Alternatively, electrical wires coming from an external location could supply power to an LED lamp, described below. The heat sink body has radially extending fins. The heat sink 13 is connected to a base 15 which in turn is connected to a cylindrical housing 17.

Figure 2B:
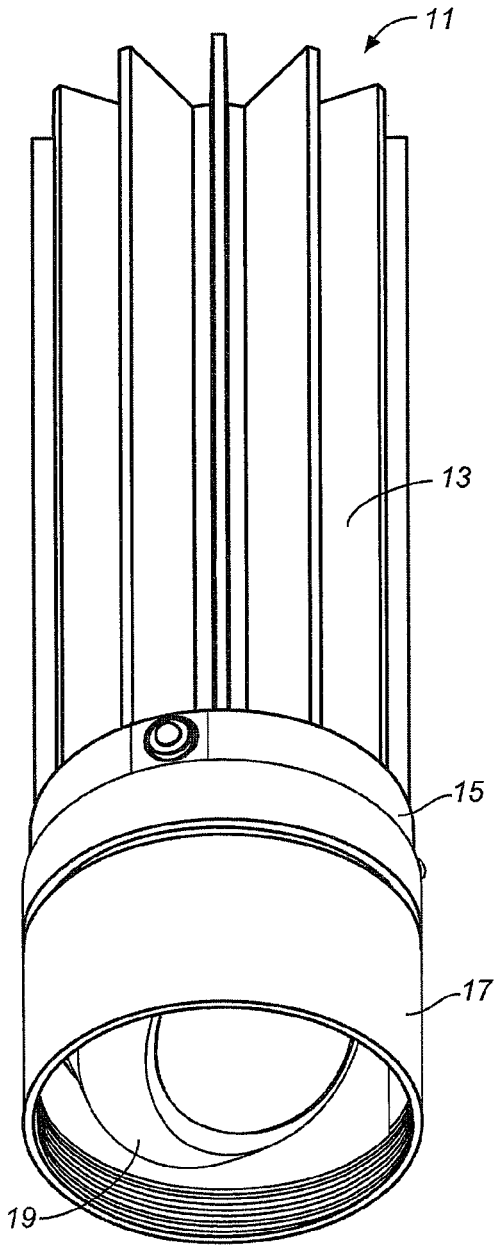
FIG. 2B is a lower perspective view of the luminaire shown in FIG. 1A.

In FIG. 2B, all of the components shown in FIG. 2A may be seen, together with reflector 19 which directs a beam of light out of the luminaire as described below. The reflector 19 is associated with a light source which may be an LED source, or another source, preferably a semiconductor source.

Figure 3A:
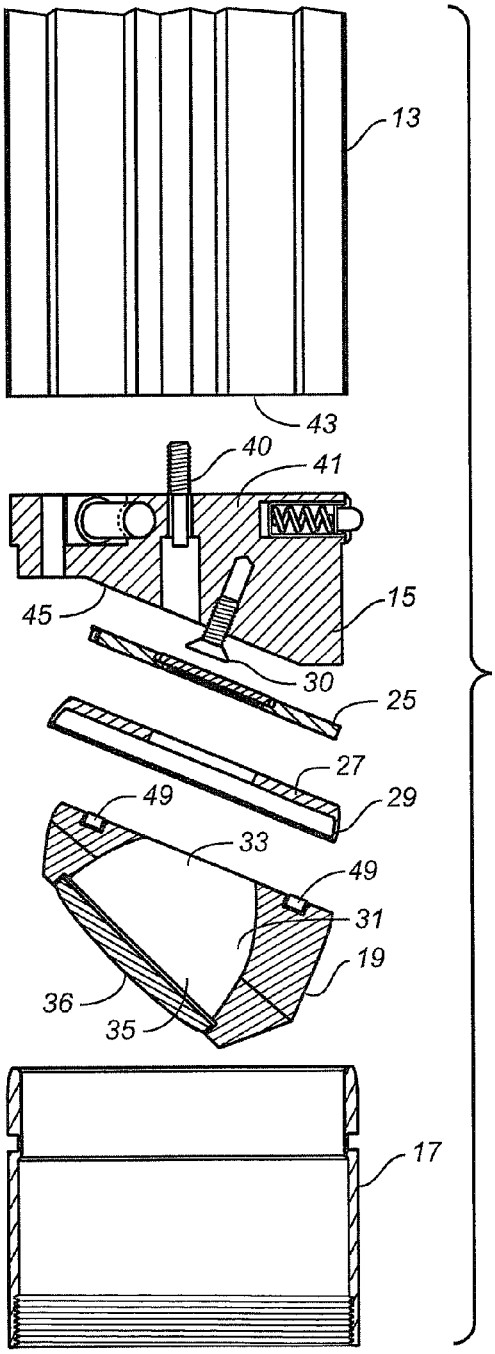
FIG. 3A is a fully exploded, partial x-ray side view of components of the luminaire of FIGS. 2A and 2B.

Details of the reflector structure may be seen in FIG. 3A where the reflector 19 is shown above its housing 17. The interior of the reflector may be a reflective coating, such as a vapor deposited aluminum coating, or a thin shell of reflective material. Base 15 may be seen more fully and separated from heat sink 13. Sandwiched between the base 15 and reflector 19 is light emitting board 25 that carries an LED chip, or the like. The board is a substrate having a semiconductor light emitting chip adhered to the board for example by surface mounting. The board can be held in place by screws, such as the screw 30.

The base may be secured to heat sink in a fixed position by means of screws, such as the screw 40. The base 15 is seen to have a first surface 41 which is joined to a first end 43 of heat sink 13. A second surface of base 15 has a major portion 45 inclined at a first angle relative to the axis previously described. The term "major portion" does not refer to size but to function, as in "significant" portion". The base. 15 serves as a support for reflector 19 which is connected by magnets. The reflector 19 sandwiches the light emitting board 25 and the reflector holder 27 in a contacting relationship among the members. The reflector 19 is joined to the light emitting board 25 by the intervening reflector holder 27 which has a flanged rim 29 that surrounds the periphery of reflector allowing rotation of the reflector in the reflector holder. The reflector is held to reflector holder 27 by magnets 49.

The central portion of the reflector has a tapered cylindrical surface that is reflective of light into a cone. The tapered surface has an open narrow end 33 and a wide end 35 through which a light emerges in a beam. The wide end may be closed by a diffuser and/or a lens 37. The tapered surface 31 is reflective of light into a cone or a divergent beam. The tapered cylindrical surface of the reflector has an axis which is inclined at an angle relative to the major axis of the heat sink.

The angle of the second surface 45 of base 15 is seen to be a different angle from the angle made by the wide end 35 of the reflector 19. However, as the reflector rotates, the difference between the two angles will vary as described below with reference to FIGS. 8A-8C. Rotation of the reflector 19 may be done by hand, merely rotating the reflector within the reflector holder 27. Rotation is permitted because the reflector is joined to the reflector holder by small magnets 49 in the upper open narrow end of the reflector. The reflector holder 27 is made of a ferromagnetic material that allows joinder of the reflector to the reflector holder, as well as rotation of the reflector on the fixed reflector holder.

Figure 3B:
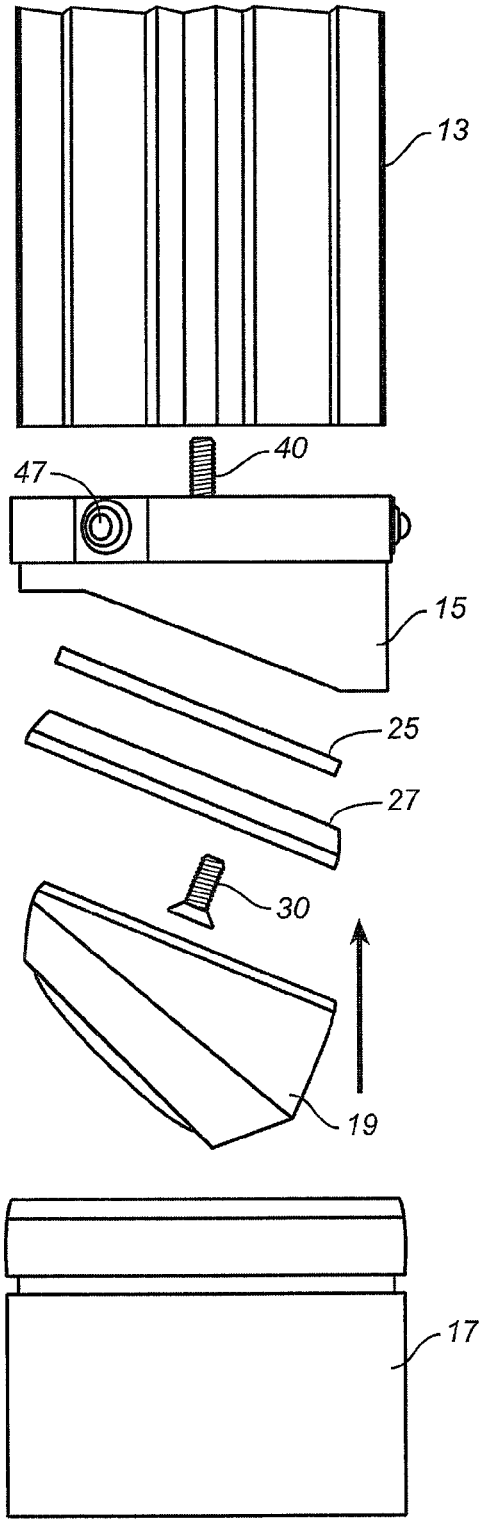
FIG. 3B is a fully exploded side view of components of the luminaire of FIGS. 2A and 2B with the orientation of FIG. 3A.
Figure 3C:
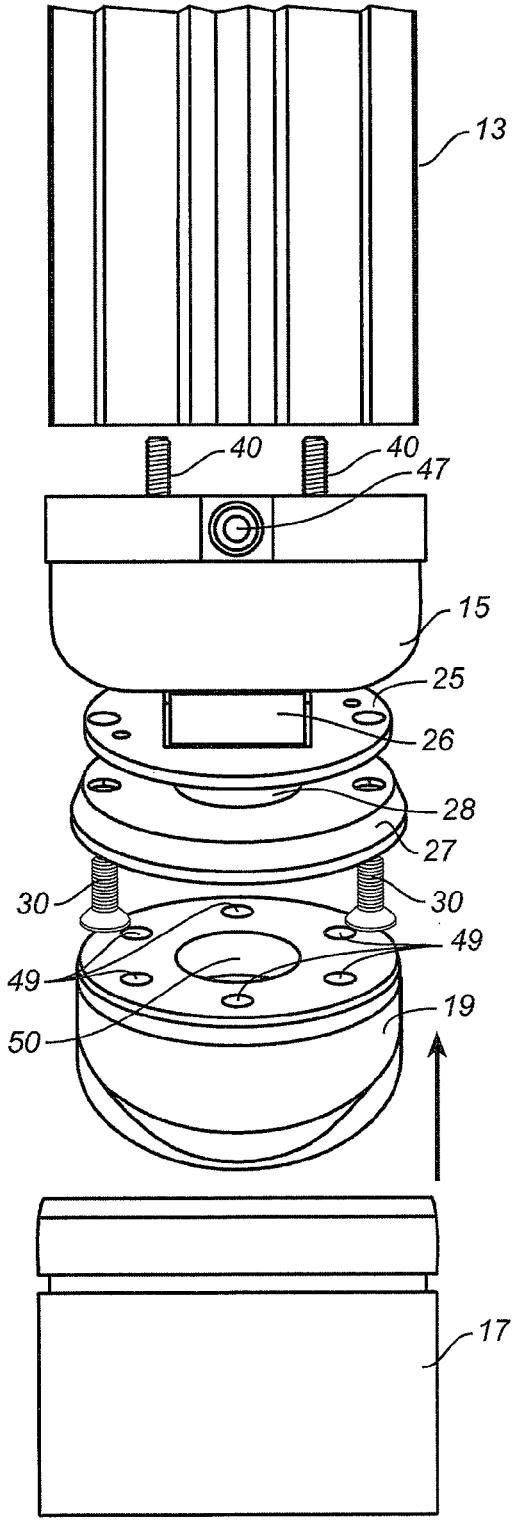
FIG. 3C is a fully exploded side view of components of the luminaire of FIGS. 2A and 2B with an orientation that is rotated ninety degrees clockwise relative to FIG. 3B.

In FIGS. 3B and 3C, the components described above may be seen in two different angular orientations. In the first angular orientation of FIG. 3B, the reflector 19 is seen being connected to base member 15 with the intervening light emitting board 25 and the reflector holder 27 held in place by screw 30. The reflector 19 will direct light at a oblique angle, rather than directing light downwardly. The oblique angle is variable as the reflector 19 is rotated in the reflector holder 27. Where a surface of the base is inclined at a first angle relative to the cylindrical axis and the wide end of the reflector has a major peripheral portion inclined at a second angle relative to the axis of the cylinder, the two angles are additive with total angle changing as the reflector 19 is rotated in the reflector holder 27.

As previously mentioned, the beam angle can vary from zero to 45 degrees, or more. The angle of the base and the angle of the reflector are additive, so that any beam angle can be created. In FIG. 3C, the luminaire reflector is shown rotated by 90 degrees. Magnets 49 on the backside of the reflector allow joining of the reflector to the reflector holder 27. The chip board 25 is seen to support an LED semiconductor chip 26 that is held in place by screws 30 extending through the reflector holder 27 and into the base member 15. Chip 26 may be a surface-mounted light emitting diode that receives power through the backside of the board by means of wires extending through the base member 15 and through the central axis of the heat sink 13. Light from the chip 26 goes through a central aperture 28 in the reflector holder 27 and through an aperture 50 in reflector 19 where a beam is formed. The light beam passes into housing 17 and exits the fixture.

Figure 4:
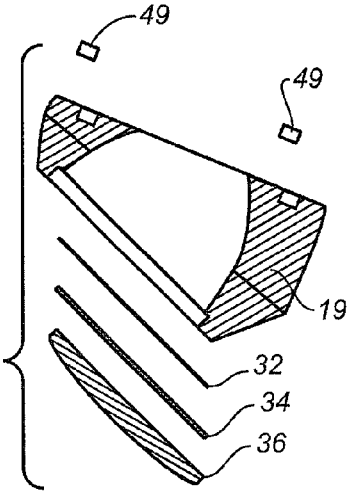
FIG. 4 is a side exploded view of components of the reflector shown in FIG. 3A.

With reference to FIG. 4, reflector 19 is seen to have several optional closure members at the output end of the reflector including an optional filter member or color modification film 32, an optional diffuser 34, and an optional focus lens 36. Positions of these elements may be interchanged or varied. The lens may be convex, concave or with combined surfaces including a planar surface. One or more of these optional components may be used either alone or in combination with each other.

Figure 5A:
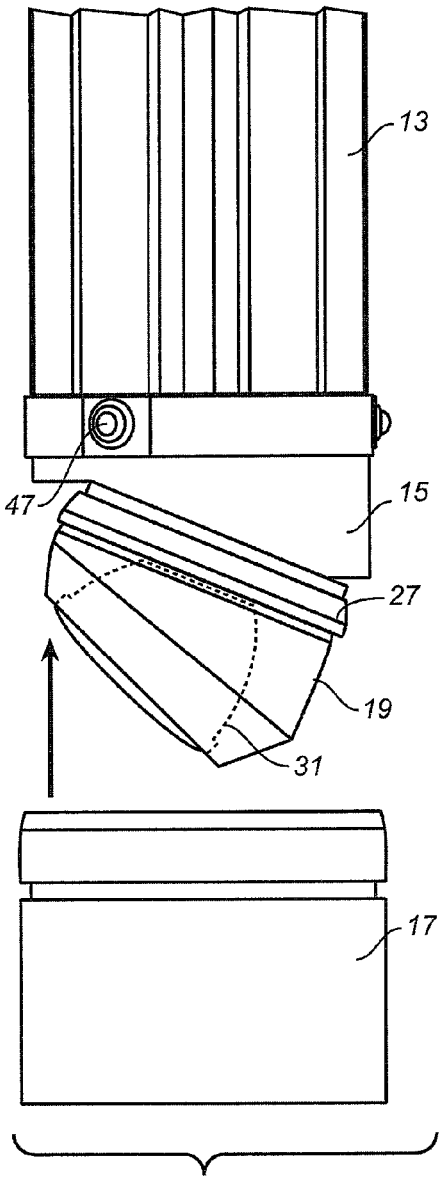
FIG. 5A is the luminaire of FIG. 1A with a reflector orientation in a first position.
Figure 5B:
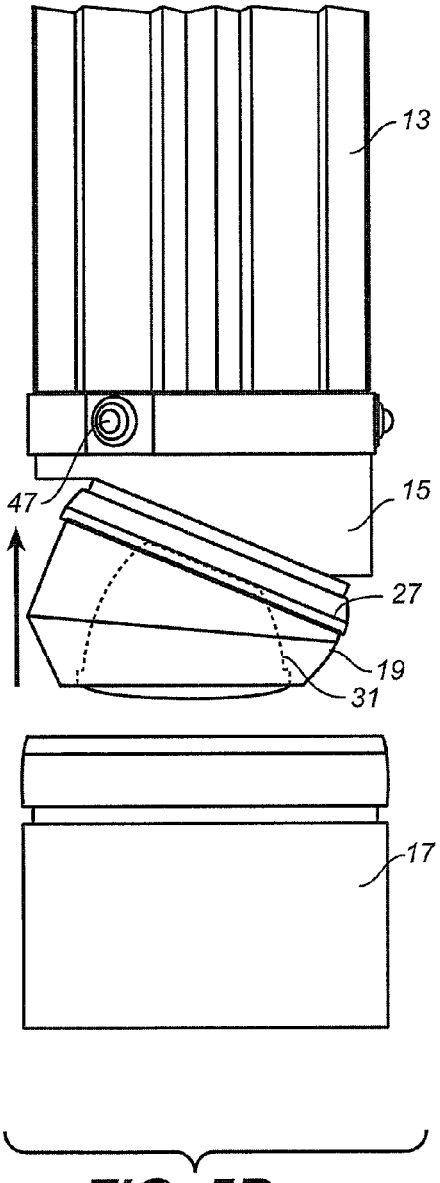
FIG. 5B is the luminaire of FIG. 5A with a reflector orientation in a second position.

In FIGS. 5A and 5B, reflector 19 has the truncated conical reflective surface 31 in different positions as the reflector 19 is rotated in the reflector holder 27, supported by base 15. In the arrangement of FIG. 5A, the reflector is seen to have a tapered conical reflector surface 31 inclined at an oblique angle relative to the axis of the heat sink. On the other hand, when the reflector is rotated in the reflector holder 27, the conical reflector surface 31 is seen to change in orientation so that an output beam will be approximately axially aligned with the heat sink. In both cases, light passes from the reflector 19 into the housing 17 and then exits the device. Cylindrical housing 17 abuts an amount of the base to a slight step where it is stopped so that the housing cannot overlap or surround the upper circumferential portion of the base. The cylindrical housing extends axially forwardly of the base so that the reflector is protected.

Figures 6A, 6B:
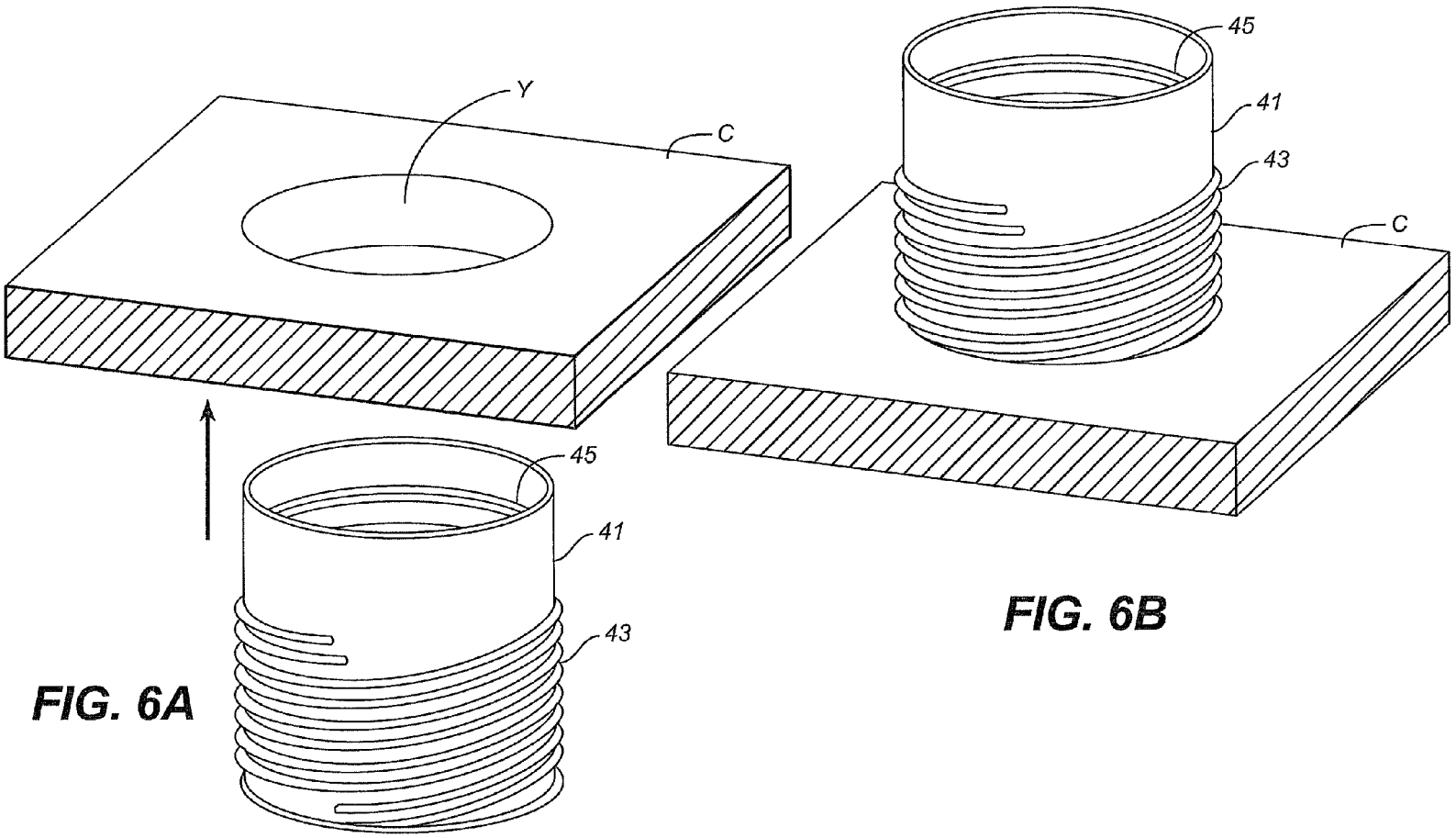
FIG. 6A is an exploded perspective view of a ceiling mounting fixture for the luminaire of FIG. 1A.
FIG. 6B is a perspective view of the mounting fixture of FIG. 6A shown in a portion of a ceiling.

In FIG. 6A, a tubular mounting sleeve 41 is seen to have peripheral threads 43 that engage an aperture Y in ceiling C. The tubular mounting sleeve is hollow to receive the luminaire. An indented circular rim 45 engages with protrusions in the base member. In FIG. 6B, the tubular mounting sleeve 41 is seen to be fully seated in the ceiling C.

Note that no screws or clips are required to mount the sleeve 41 to a ceiling. The sleeve 41 is self-mounting, threaded into place with no separate operation required to secure it. Since the sleeve protrudes into the space beyond the ceiling, there is additional surface area for support of the luminaire within the sleeve and above the ceiling. The sleeve has dual external threads, equally spaced on the circumference of the sleeve, each thread having a separate start and end point. By using more than one thread the sleeve is more likely to be threaded straight into a hole.

There is a small radially protruding lip near the downward end of the sleeve. This lower lip acts as a stop so that the shroud cannot be threaded indefinitely into the hole but is stopped slightly beyond the thread pattern. Without the lip it is possible to thread the sleeve all the way through the ceiling so that it falls to the other side. The threads have a non-standard, relatively large pitch so that the spacing between the threads is large. For example, for a sleeve having a 2 inch diameter, a one-quarter inch pitch would be typical. By using a large pitch fewer revolutions are required to thread the sleeve into place. Larger pitch also keeps brittle material such as Sheetrock™ from cracking.

The lower internal periphery of the sleeve can have axial tool slots parallel to the axis of the sleeve, i.e., indentations in the sleeve material, for receiving a tool that turns the sleeve. The number of tool slots is arbitrary but sufficient for overcoming threading resistance. An internal circumferential rim 45 in the sleeve can be designed to accept the spring plungers or protrusions 47 in FIGS. 5A and 5B, thereby holding the luminaire in place in a ceiling.

Figure 7A:
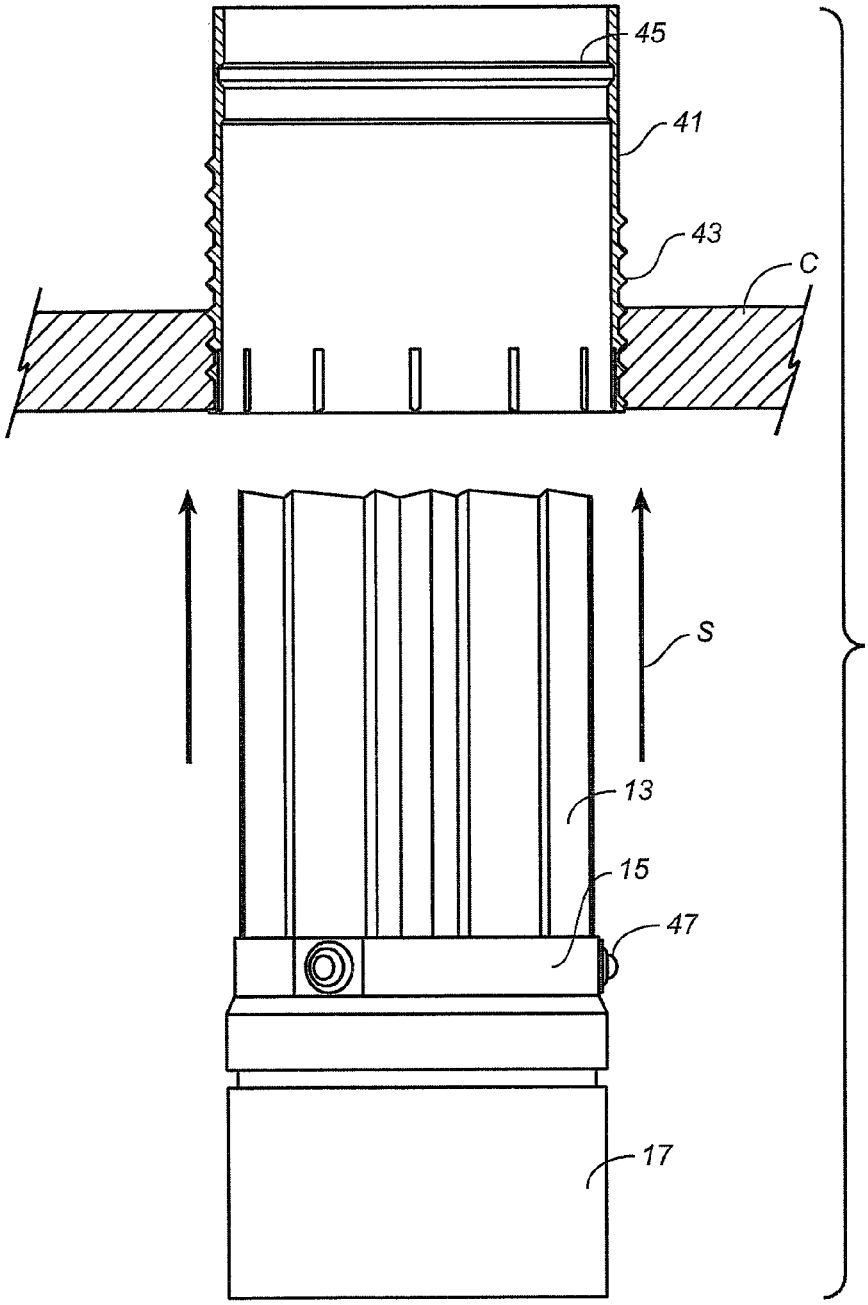
FIG. 7A is a luminaire of FIG. 1A being inserted into the mounting fixture shown in FIG. 6B.
Figure 7C:
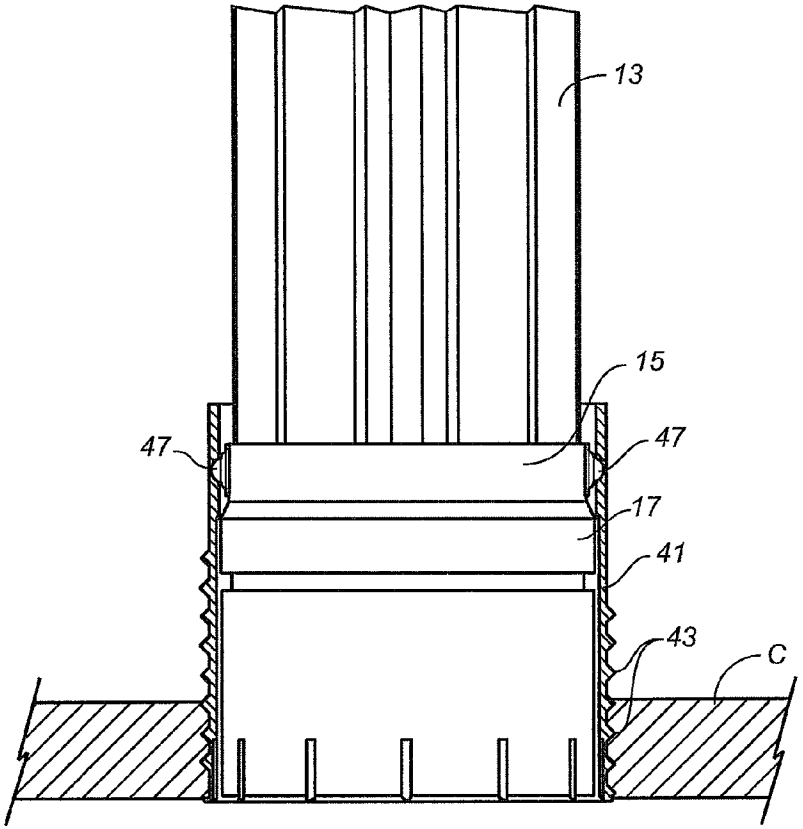
FIG. 7C is sectional view taken along lines 7C-7C of FIG. 7B.
Figure 7B:
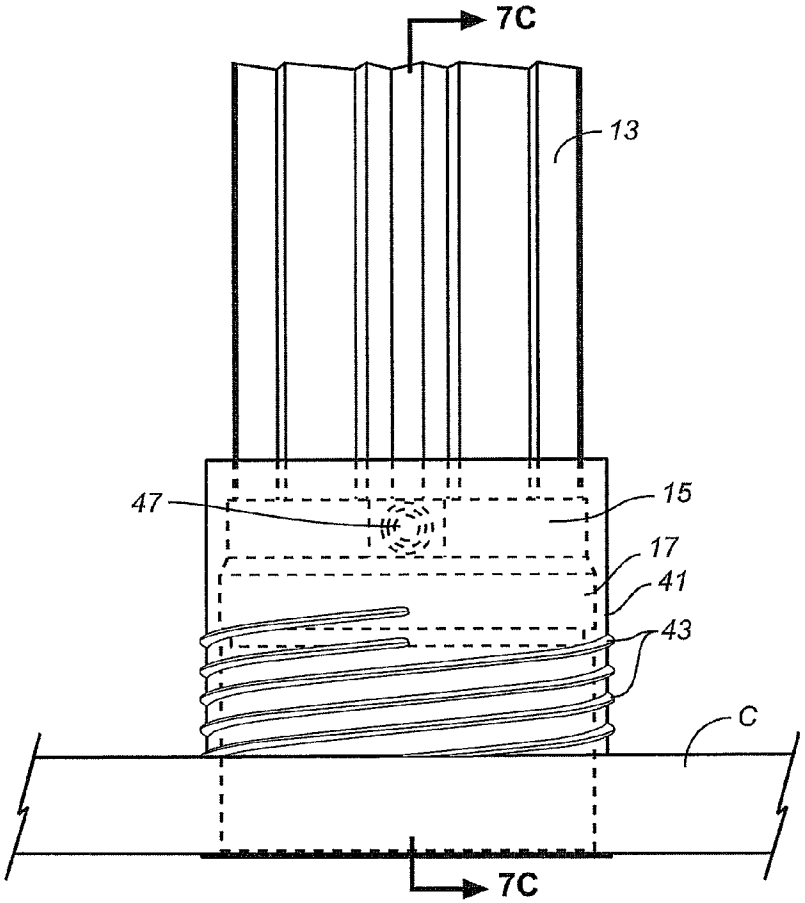
FIG. 7B is a side x-ray view of the luminaire shown in FIG. 2A in the mounting fixture.

In FIG. 7A, the heat sink 13 is shown being inserted into tubular mounting sleeve 41. The mounting sleeve is seen to be held in place by threads 43 which are engaging the aperture of ceiling C. As the luminaire is raised in the direction of the arrows S, the protrusions 47 will engage the indented rim 45 within the tubular mounting sleeve. The rim 45 is sufficiently elevated in the tubular mounting sleeve so that the mounting sleeve totally encloses, or at least substantially encloses the cylindrical housing 17 of the luminaire, as seen in FIGS. 7B and 7C. In FIG. 7B the tubular mounting sleeve 41 is seen to be engaged with and by the protrusion 47 in base 15. Threads 43 of mounting sleeve 41 are seen to be threaded into ceiling C. The axis of heat sink 13 is approximately vertical with respect to ceiling C, while light can emerge at a selected angle, depending upon rotation of the reflector member at the same the azimuth of the entire apparatus can be changed by rotating the cylindrical housing 17 within the tubular mounting sleeve 41.

Figure 8C:
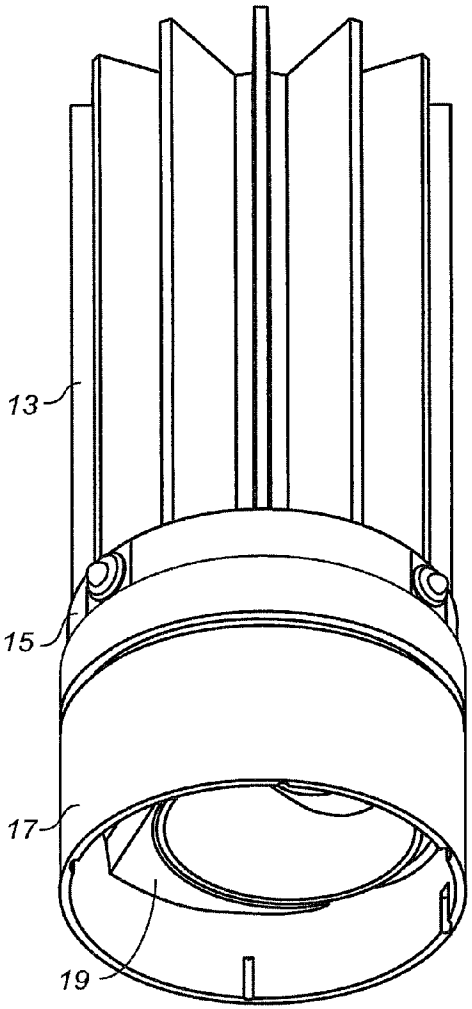
FIGS. 8A, 8B, and 8C are perspective operational views showing three different angles of beam tilting with rotation of the reflector components similar to the reflector components of FIGS. 5A and 5B.
Figure 8B:
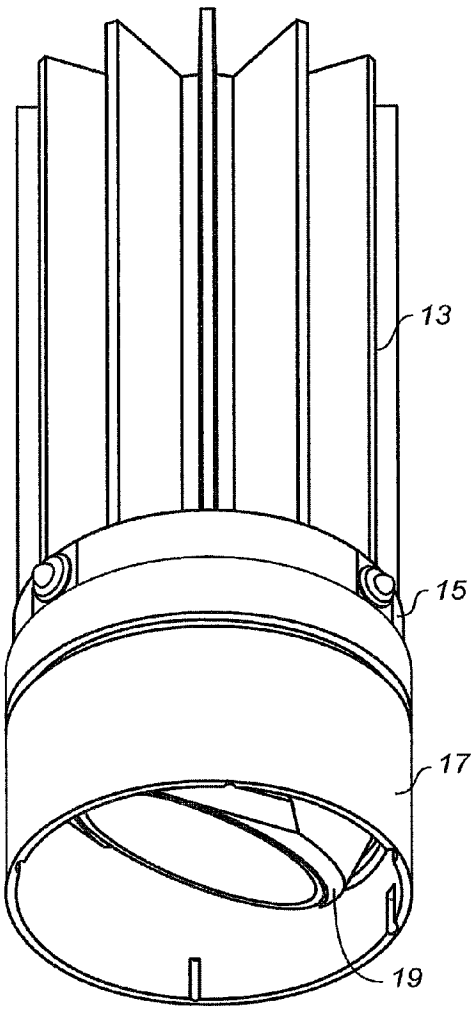
Figure 8A:
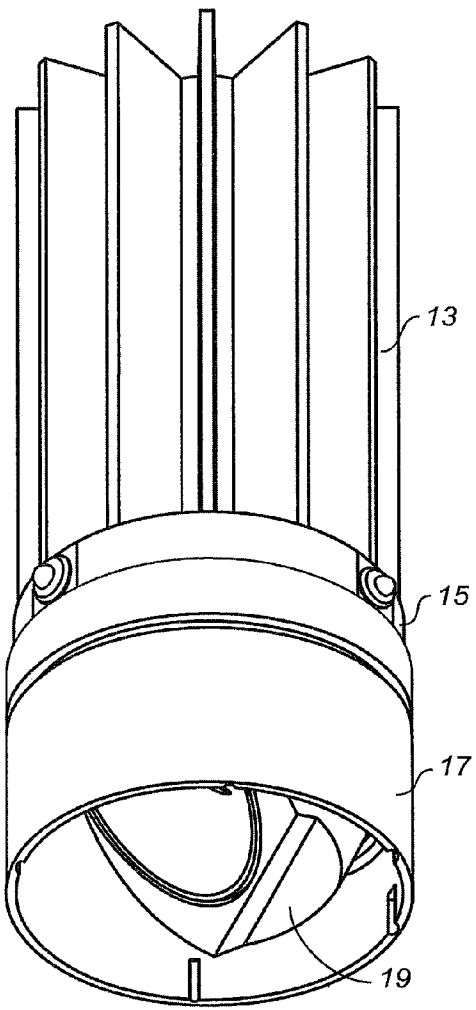

In FIGS. 8A, 8B, and 8C, rotation of the reflector member 19 can be seen. In FIG. 8A, the reflector will direct light obliquely to the left as the reflector is rotated clockwise. In FIG. 8B, the reflector will direct light toward the back plane of the paper. Counter clockwise rotation is shown in FIG. 8C will direct light straight down as the reflector 19 is rotated.

What is claimed is:

1. A luminaire comprising:

a cylindrical heat sink having an axis with opposed first and second ends and a diameter;

a cylindrical base coaxial with the heat sink, the base having an upper end coupled to a first end of the heat sink and having a lower end inclined at a first angle relative to the axis, the base having a diameter similar to the diameter of the heat sink;

a light emitting board or chip with a light source thereon joined to the lower end of the base by a ferromagnetic annular member having a flanged rim serving as a reflector holder; and a reflector having an upper surface magnetically joined to the ferromagnetic annular member and rotatable within the flanged rim thereof, the upper surface of the reflector having a central aperture for allowing light from the light source to pass into the reflector and having a radially tapered surface reflective of light into a conical beam, the tapered surface having a narrow open end at the central aperture and an opposed wide end where the beam emerges and further having a lower surface truncating the radially tapered surface at a second angle relative to the axis at the wide end thereof;

whereby rotation of the reflector causes additive combination of the first and second angles so that the inclination of the light cone and beam relative to the axis are variable and rotatable with rotation of the base.

2. The apparatus of claim 1 wherein the reflector is made of non-magnetic material having embedded magnets therein.

3. A luminaire comprising:

an elongated heat sink having an axis, and opposed first and second ends;

a base member having a first surface joined to the first end of the heat sink and a second surface with a major portion inclined at a first angle relative to said axis;

a light emitting board joined to the base member with a light source on the board;

a reflector joined to the light emitting board in a rotatable manner, the reflector having a central aperture for allowing light from the light source to pass into the reflector and having a radially tapered cylindrical surface reflective of light into a conical beam, the tapered surface having an open narrow end and a wide end, the open narrow end proximate to the light source, and further having a major peripheral portion included at a second angle relative to said axis at the wide end thereof;

whereby rotation of the reflector causes additive combination of the first and second angles so that the conical beam has variable inclination to the axis.

4. The apparatus of claim 3 wherein a reflector holder member is interposed between the reflector and the light emitting board.

5. The apparatus of claim 4 wherein the reflector holder is a ferromagnetic member and the reflector is magnetically joined to the reflector holder.

6. The apparatus of claim 5 wherein the reflector holder has a flanged rim into which the reflector fits for rotation.

7. The apparatus of claim 3 where the reflective surface of the reflector is a reflective coating.

8. The apparatus of claim 3 wherein the elongated heat sink is cylindrical.

9. The apparatus of claim 3 further comprising a tubular cylindrical housing surrounding of reflector.

10. The apparatus of claim 9 wherein the cylindrical housing surrounds a first circumferential portion of the base.

11. The apparatus of claim 9 wherein the base has a second circumferential portion extending radially outwardly from the first circumferential portion by a step amount in a manner whereby the cylindrical housing abuts the step amount of the base so that the housing cannot surround the second circumferential portion of the base.

12. The apparatus of claim 9 wherein the cylindrical housing extends axially forwardly of the reflector thereby protecting the reflector.

13. The apparatus of claim 9 further comprising a tubular mounting sleeve that circumferentially surrounds the cylindrical housing.

14. The apparatus of claim 13 wherein the base has a plurality of spaced apart detents and the mounting sleeve has at least one internal slot or groove into which the spaced apart detents reside.

15. The apparatus of claim 3 wherein the light emitting board comprises an insulative washer-shaped substrate carrying an LED chip.

16. The apparatus of claim 3 wherein the wide end of the reflector has a lens.

17. The apparatus of claim 3 wherein the wide end of the reflector has a light diffuser.

18. The apparatus of claim 13 wherein the tubular mounting sleeve has radially outwardly extending protrusions for engaging a ceiling.

19. The apparatus of claim 18 wherein said protrusions are screw-threads whereby said mounting sleeve can be screwed into a ceiling.

* * * * *